US008880362B2

(12) United States Patent
Wilkens et al.

(10) Patent No.: US 8,880,362 B2
(45) Date of Patent: Nov. 4, 2014

(54) SYSTEM AND METHOD FOR MONITORING PAINT FLOW IN PAVEMENT MARKING APPLICATIONS

(75) Inventors: Jeffrey Arnold Wilkens, West Fargo, ND (US); Timothy John Marthe, Relies Acres, ND (US); Kalvin Ambrose Hoff, Fargo, ND (US)

(73) Assignee: EPIC Solutions, Inc., Fargo, ND (US)

( * ) Notice: Subject to any disclaimer, the term of this patent is extended or adjusted under 35 U.S.C. 154(b) by 142 days.

(21) Appl. No.: 13/020,622

(22) Filed: Feb. 3, 2011

(65) Prior Publication Data

US 2012/0203475 A1 Aug. 9, 2012

(51) Int. Cl.
*B05B 9/06* (2006.01)
*E01C 23/20* (2006.01)

(52) U.S. Cl.
CPC .. *E01C 23/20* (2013.01); *B05B 9/06* (2013.01)
USPC ..... 702/47

(58) Field of Classification Search
USPC ..... 702/47, 45, 96, 138, 170
See application file for complete search history.

(56) References Cited

U.S. PATENT DOCUMENTS 4,093,107 A * 6/1978 Allman et al. ..... 222/23
4,247,045 A * 1/1981 Mitchell et al. ..... 239/156
5,540,518 A * 7/1996 Wambold ..... 404/84.05
5,599,133 A 2/1997 Costello et al.
5,911,362 A * 6/1999 Wood et al. ..... 239/1
6,439,473 B1 * 8/2002 Meyer et al. ..... 239/69
6,729,706 B1 * 5/2004 Patton et al. ..... 347/2
6,913,417 B2 7/2005 Lind et al.
7,957,841 B2 * 6/2011 Zarowny et al. ..... 700/282
2003/0157262 A1 * 8/2003 Cebola ..... 427/421
2003/0177978 A1 * 9/2003 Nobutoh et al. ..... 118/663
2005/0127088 A1 * 6/2005 Gardos ..... 222/1
2008/0271674 A1 * 11/2008 Rademacher et al. ..... 118/707
2008/0300727 A1 * 12/2008 Zarowny et al. ..... 700/282
2012/0012684 A1 * 1/2012 Mansheim et al. ..... 239/600

OTHER PUBLICATIONS

Yi Jiang, Durability and Reto-Reflectivity of Pavement Marking (Synthiesis Study), 2008, Purdue University Purdue e-Pubs. pp. 4-14.*

* cited by examiner

*Primary Examiner* — Michael Nghiem
*Assistant Examiner* — Eman Alkafawi
(74) *Attorney, Agent, or Firm* — Russell T. Manning; Marsh Fischmann & Breyfogle LLP

(57) ABSTRACT

Presented herein are a system and method (i.e., utilities) for monitoring the flow of materials used to mark road surfaces and other surfaces. The utilities utilize one or more pressure sensors to monitor in-line pressure of road marking material to determine the amount of material being applied. Electronic equipment receives signals from the pressure sensors, temperature sensors and/or additional monitoring equipment to generate an output indicative of an amount of material flow. In a further arrangement, the equipment generates an output indicative of a thickness of the read marking material as applied to a surface.

15 Claims, 3 Drawing Sheets

SYSTEM AND METHOD FOR MONITORING PAINT FLOW IN PAVEMENT MARKING APPLICATIONS

FIELD

The present invention relates to pavement marking. More particularly, the invention relates to the application of pavement marking materials including paint, epoxy, MMA, and thermoplastic to a road, runway, or any other type of surface by a moving vehicle.

BACKGROUND

It is well known that roadways, runways, and other types of surfaces need to have lines or intermittent stripes painted on them to guide traffic, airplanes, etc. A pavement marking material such as, for example, conventional paint, epoxy, MMA, or thermoplastic (referred to herein generally as "paint") is used to create visible stripe paint line. Glass beads may be applied to the freshly painted surface immediately after the pavement marking material is applied. The glass beads serve to make the stripes or lines more visible because they reflect light, such as from a vehicle's headlights.

Typically, a flatbed truck is configured to carry all the necessary supplies and equipment so that pavement marking material and beads can be applied to the road surface in an economical fashion. A truck used to apply beads and pavement marking materials, referred to herein as a paint truck, has one or more pavement marking material tanks and one or more bead tank. The bead tank(s) is/are usually large enough to hold sufficient beads for the application to the pavement marking materials in the paint tanks. In some embodiments, different bead tanks may include different types of beads. In operation, paint trucks may travel as fast as 25 mph while painting continuous or intermittent paint lines on the road surface.

Various different systems are utilized to apply paint and can vary based on the type of paint being applied. For instance, "spray," "extrusion," and "ribbon gun" are the systems frequently used to apply thermoplastic paints. In these systems the thermoplastic starts out in a solid form, which is heated past its melting point using a furnace mounted on the truck. In alternate arrangements, a separate pumper truck may provide pre-melted materials to a tank of the paint truck. Once the thermoplastic is a liquid material (i.e., melt), the thermoplastic melt is ready for application to a surface. In a spray system, the thermoplastic melt is pumped using a high pressure pump, which pushes the material through a small opening/orifice at the paint gun. This creates a line on the roadway. In the extrusion system, the thermoplastic melt is pumped at a lower pressure and gathers in a collection box disposed by the road surface. The box opens when material is desired and small, flat stream of material is placed on the ground as the vehicle moves forward. The ribbon gun method is similar to extrusion system with the exception of the box used to gather material by the road surface. A ribbon gun places material directly on the roadway after passing through a flat opening as wide as the desired line.

Beads are generally applied using a "pressure pot" system where pressure applied to the holding tank of the beads forces the beads through subsequent connecting lines to an application gun. Glass beads are placed on the paint after the paint gun to help with reflection of the line. Regardless which paint and bead system or combination of systems is used, the equipment for such systems is typically mounted on a flatbed truck.

There is usually a specific amount of paint and beads that one is required to apply per foot to meet various specifications (e.g., state highway requirements). For example, such a specification may require that a 300 lineal feet of a 4 inch wide paint line utilize a gallon of paint and 6 lbs. of beads. Accordingly, it is desirable to monitor the amount of material applied in order to comply with necessary specifications and/or to avoid over application (e.g., waste) of such materials. However, operators often rely on little more than visual inspection, intuition and experience to know how much or how little material they are putting down. For instance, one method commonly used to determine material thickness for thermoplastics is to spray the material onto a flat piece of aluminum and use a micrometer to determine the thickness that the line being applied. This 'calibration' information is then utilized to gage application. However, in many instances, such calibration information may change during application.

The volume of paint applied by a spray gun or ribbon gun can change due to a number of different factors. For instance, paint systems typically utilize a number of filters between the gun(s) and the tanks. If the filters accumulate contaminates, the volume of paint supplied to the guns can change. Likewise, in thermoplastic applications the temperature of the thermoplastic melt can affect its viscosity and, therefore, the volume of melt supplied to the paint gun. Further, it is common for the temperature of the melt vary. When such variation occurs, the amount of paint being applied to the roadway may increase or decrease.

Being able to more accurately monitor the amount of paint and/or beads being applied allows the contractor to immediately make adjustments to compensate for such conditions rather than his finding out that he has been applying to little paint to meet specifications for a portion of entirety of a job. Yet another benefit of constantly monitoring paint and/or bead usage would be that the contractor could accurately determine when the supply of paint and/or beads in the tanks on the truck will run out. That is important because in many situations the tanks on the painting truck can not readily be refilled. For example, on interstate highways, safety regulations prohibit filling the paint and or bead tanks on paint trucks on the interstate highway. The paint truck must exit the interstate prior to refilling its tanks. If a contractor knows that the paint and/or bead supply is running low, he or she can exit the interstate at a convenient time prior to running out of paint and/or beads. If the contractor runs out he has to drive to the next exit, get refilled, then backtrack far enough to get back to the point where he ran out. This results in a waste of time. The problem of such inefficiencies—and how they are magnified—becomes clear when one appreciates that a paint truck must always operate with several other traffic control vehicles. So it is not one, but several vehicles which must backtrack in these circumstances.

Beyond experience and intuition, certain devices and methods exist in the prior art for monitoring the amount of materials being used. For both beads and paint tanks, one can measure the amount of materials used to refill the tanks. Whatever volume of materials was used is then divided into the number of lineal feet painted since the last refilling stop to determine material usage. Another method entails the use of flow meters, which can be placed in the lines connecting the paint tanks to the discharge nozzles.

In the case of thermoplastic there are obstacles that have prevented the use of flow meters. First, thermoplastic melts are heated beyond the operation range of flow meters. A second problem is the abrasive nature of the material. Flow meters that operate by inserting some kind a paddle wheel into the path of the material flow will quickly cease to work because the material will simply eat away the paddle wheel as it flows past due to friction. Other non-intrusive flow meters may also not work in such an environment. Certain non-intrusive flow meters rely on bouncing electronic signals back and forth from one side of a pipe to the other. These signals are can then determine the flow through the pipe. However, thermoplastic can contains glass beads within its melt, these glass beads scatter the electronic signal and make it impossible to measure flow.

SUMMARY

The present invention allows the real time or near-real time monitoring of paint usage. The disclosed systems and methods (i.e., utilities) allow for monitoring paint usage by continually measuring line pressure, distance traveled (e.g., vehicle speed) and optionally temperature. Based on these inputs, the utilities repeatedly calculate material flow. Because the present invention involves constantly measuring pressure, vehicle speed and/or material temperature, the present invention is not limited by the type of system being employed and is suitable for all applications. However, the system is particularly apt for use with thermoplastic applications where, as noted above, difficulties arise when measuring material flow rates.

In one aspect the utility monitors the amount of material being applied to a surface. The utility includes a pressure-measurement device that generates an electronic signal representative of the material pressure in a paint gun supply line. The utility utilizes a microprocessor that is programmed to receive the electronic signals from the pressure measurement device to calculate the thickness of material being applied to a surface. Typically, the processor also receives a travel speed for use in calculating the line thickness. Further, the processor may include user set information relation to orifice outlet size(s) of the spray gun(s) and/or supply line size (e.g., diameter). In one arrangement, the processor utilizes these inputs with empirically determined data to determine the thickness of the material as applied to the surface.

A second aspect provides a device for applying a pavement marking material and, optionally beads, to a roadway. The device includes a first tank for the pavement marking material, and a first pressure measurement device that generates a first electronic signal representative of the pressure of a paint supply line between the paint tank and a paint gun. The device may also include a second tank for the beads, and a weight measurement device that generates an electronic signal representative of the weight of the beads in the second tank. The device also includes at least one paint gun for applying pavement marking material to the roadway and optionally includes at least one bead gun for applying beads to the roadway. A monitoring device provides a second electronic signal indicative of vehicle speed over a roadway. In an optional arrangement, a temperature monitoring device provides a third electronic signal indicative of a temperature of the pavement marking material. The device also includes a microprocessor programmed to receive the first and second and in some arrangements the third electronic signals and output at least one of the following: the total amount of pavement marking material being applied to the roadway; the linear feet of pavement marking material applied to the roadway; and/or the thickness of pavement marking material applied to the roadway. In addition to utilizing the first, second and in some instances third electronic signals, the processor may obtain a fourth electronic signal indicative of a pump speed that moves material between a tank and the paint gun. Further, the processor may access data stored on computer readable media. Such stored data may provide data associated with, for instance, supply line size, orifice size of the paint gun and/or bead guns. Such stored data may further include data such as look-up tables or curves, which may be generated from empirical data. Such look-up tables and curves may be utilized with one or more variables (e.g., temperature, pressure, pump speed, etc) to determine flow rate. In one arrangement, the output from the processor is displayed on a user display. Such user displays may include without limitation, lap top computers and/or dedicated user displays. In another arrangement, the output is provided to a controller that controls pump speed. In this arrangement, the pump may be automatically controlled to maintain a thickness of the line within a desired range.

Another aspect provides a utility for monitoring the amount of material being applied to a surface. The utility includes generating a first electronic signal representative of a supply line pressure of the pavement marking material at first time and generating a second electronic signal representative of the speed of the vehicle over a surface. A third electronic signal representative may optionally be generated that is indicative of the temperature of the material in a supply line between a material tank and paint gun. These signals are transmitted to a processor that generates an output indicative of the thickness of a paint line applied to a surface. The generation of the signals and thickness outputs may be repeated at subsequent times or intervals to provide a substantially continuous monitoring system.

In a fourth aspect, the invention is a computer-readable article of manufacture containing program code that, when executed by a processor, causes the processor to receive a first electronic signal representative of a line pressure of the pavement marking material. The processor also receives a second electronic signal representative of the speed of the vehicle over a surface. The processor may optionally receive a third electronic signal representative of temperature of the material in the line. Based on these inputs, the processor is operative to calculate and output a flow rate of material and/or a thickness of the material as applied to a roadway. In one arrangement, such an output is provided to an output display to allow an operator to monitor the thickness and make any necessary adjustment. In another arrangement, the output is provided to a controller operative to adjust pump speed (e.g., increase or decrease) to adjust the pressure in the supply line and thus maintain a desired thickness of the applied material.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

For a more complete understanding of the present disclosure and further advantages thereof, reference is now made to the following detailed description taken in conjunction with the drawings in which.

DETAILED DESCRIPTION

Reference will now be made to the accompanying drawings, which at least assist in illustrating the various pertinent features of the presented inventions. Though discussed primarily in relation to monitoring the application of thermoplastic melt, it will be appreciated that the presented inventions are not so limited. In this regard, the following description is presented for purposes of illustration and description. Furthermore, the description is not intended to limit the disclosed embodiments of the inventions to the forms disclosed herein. Consequently, variations and modifications commensurate with the following teachings, and skill and knowledge of the relevant art, are within the scope of the presented inventions.

Figure 1:
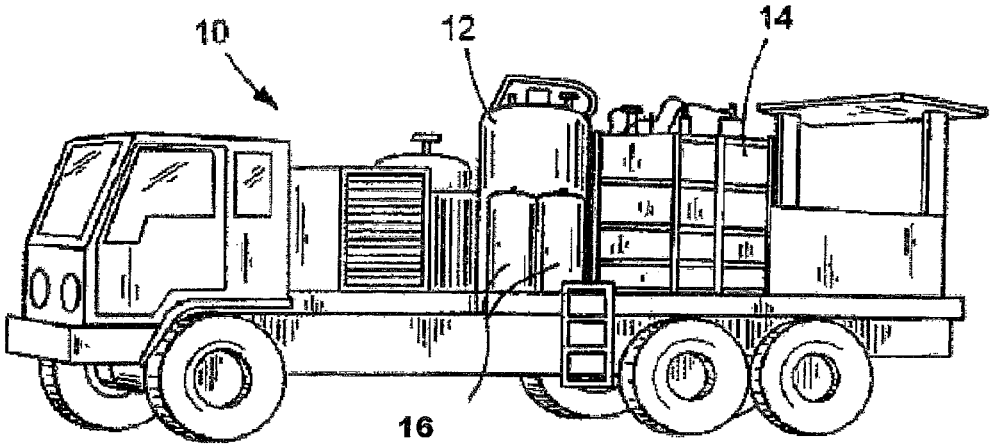
FIG. 1 illustrates one embodiment of a line painting truck.
Figure 4:
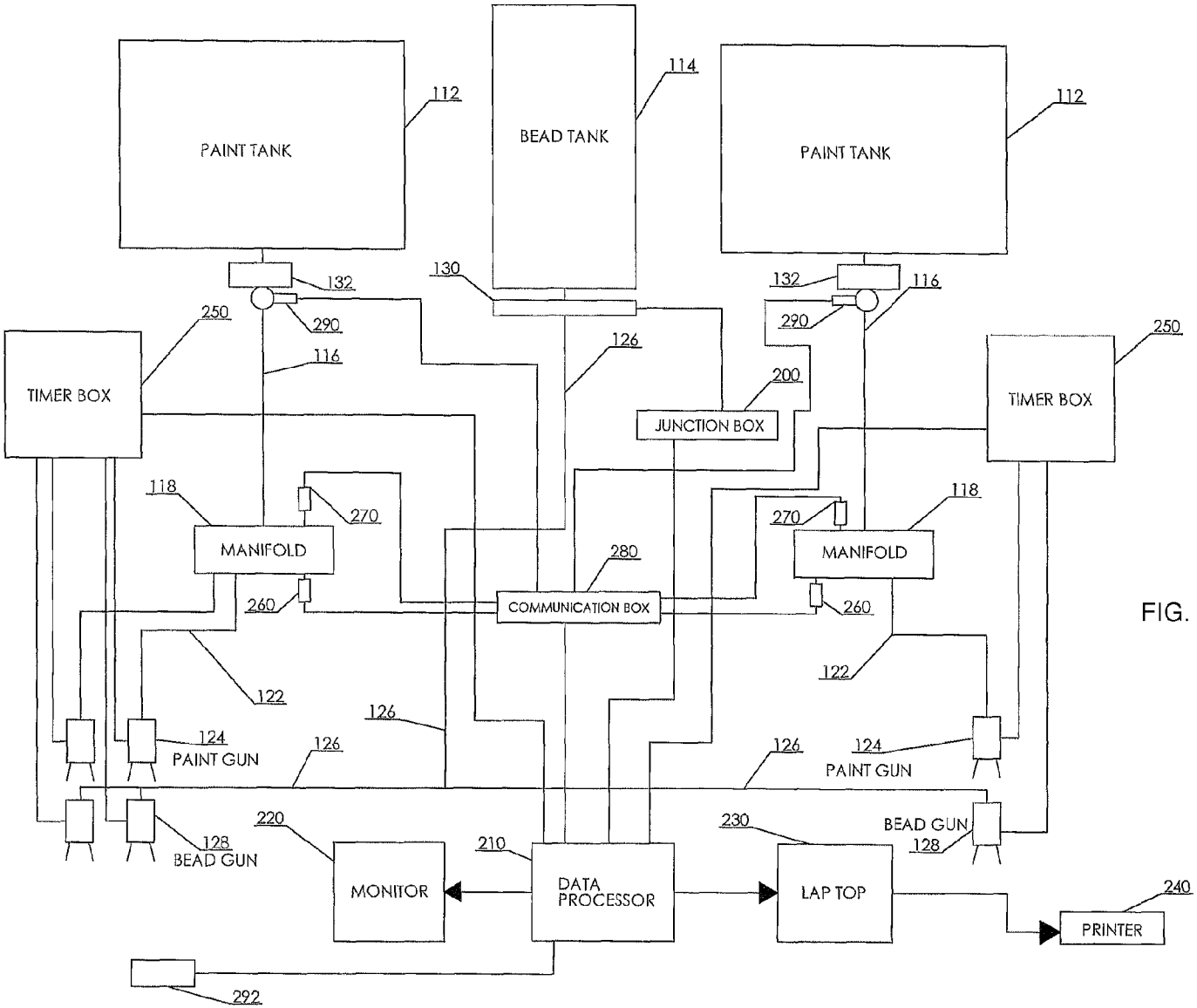
FIG. 4 illustrates a schematic representation of a system of the invention.

Referring to FIG. 1, an embodiment of the invention is shown that includes a generally cylindrical paint tank 12 that is disposed on a paint truck 10. In the present embodiment, the paint tank 12 is a thermoplastic paint tank and further includes a furnace (not shown) for melting solid thermoplastic feed stock and various gas sources 16 (e.g., propane tanks), which the furnace uses to heat the thermoplastic feed stock in the paint tank. A bead tank 14 is also on the paint truck 10. The paint tank 12 and bead tank are interconnected to one or more paint guns 124 and bead guns 128 by paint supply lines 116, 122 and bead supply lines 126, respectively, as schematically illustrated in FIG. 4.

Figure 2:
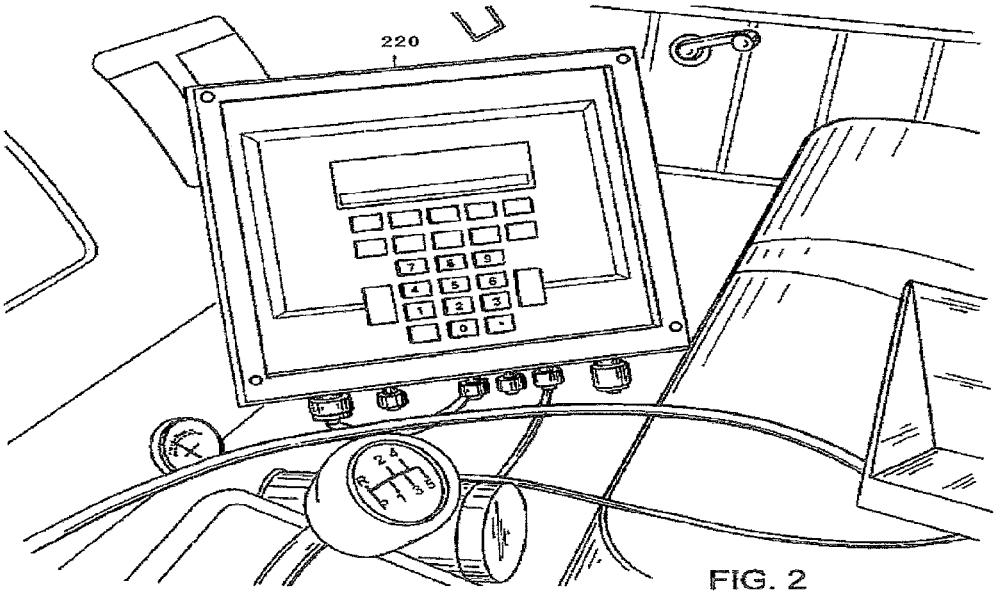
FIG. 2 illustrates a user interface disposed within the cab of the line painting truck.

FIG. 2 depicts a user interface/monitor 220 mounted inside the cab of paint truck 10. The user interface 220 is programmable and includes a microprocessor that may be instructed to monitor, collect, display and control a variety of desired information. In alternate arrangements, the user interface may be represented by a lap top computer that is operatively interconnected to the system. What is important is that the system includes a processor that is operative to receive and process signals from system components and provides a user interface to receive user input.

In the present embodiment, the bead tank 12, 14 is mounted on weigh bars that allow for monitoring bead usage from the tank. A weigh bar is a device that is fixed at one end and flexes under an applied load. Strain gauges on the bar transform this physical change into voltage values. A suitable weigh bar for use in the invention is available from Weigh-Tronic, Inc., Fairmont, Minn. However, a variety of other weight-measurement devices may be used to provide an accurate measurement of the weight of the tank. The use of a weigh bar to monitor usage of beads and, in some instances, paint is set forth in U.S. Pat. No. 6,439,473, the entire contents of which is incorporated by reference herein.

Generally, with a square or rectangular tank four weigh bars 130 are mounted one at each corner of the tank and support the tank relative to the truck 10. Voltage values gathered by the weigh bars at each tank are translated into weight readings by a processor. The weigh-bar indicator translates the voltage values into weight readings and displays that information. In one arrangement, the weigh-bar indicator includes a microprocessor that allows an operator to program the system to manipulate the voltage values from the weigh bars to calculate information for the operator. The weigh-bar indicator preferably filters and/or averages over time the data it receives from the tanks to compensate for the movement of the paint and/or the glass beads in the tank as the paint truck drives down the road. A suitable weigh-bar indicator is the WI-130, also manufactured by Weigh-Tronix, Inc, Fairmont, Minn., although other similar devices could be used in the invention.

While use of the weigh bars provides an effective means for monitoring usage of some materials, weight measurement has some limitation. For instance, weight measurement can in some applications fail to provide substantially instantaneous material flow volumes that may be utilized to calculate the volume of material being output by one of the guns or the thickness of a paint line applied to a surface. Further, in instances where thermoplastic paints are utilized, the weight of the paint supply tank 12 changes dynamically. That is, thermoplastic feed stock may be nearly continuously loaded into the tank 12 while the truck is in motion. In addition, the gas sources 16 are depleted during operation. Accordingly, accurately monitoring amount of thermoplastic in the tank and its usage is difficult or impossible. Therefore, it is desirable in some instances to utilize means other than weight to monitor flow volume.

Previous attempts to monitor material usage and/or flow volume have utilized flow meters. However, thermoplastic melts are typically heated beyond the operation range of flow meters. Often, these materials are heated in excess of 400 degrees Fahrenheit. Another problem is the abrasive nature of the material. Flow meters that operate by inserting a measurement device into the path of the material flow will quickly cease to work because the material will simply eat away the measurement device due to friction. Other styles of flow meters that are non-intrusive may not work in the present environment. That is, certain non-intrusive flow meters rely on bouncing electronic signals back and forth from one side of a pipe to the other. These signals can then be used to determine the flow through the pipe. However, thermoplastic can contain glass beads within its melt. These glass beads scatter the electronic signal and make it impossible to measure flow. Accordingly, to overcome such difficulties provided herein is a system that accurately monitors material flow volumes based at least in part on pressure measurements.

Figure 3:
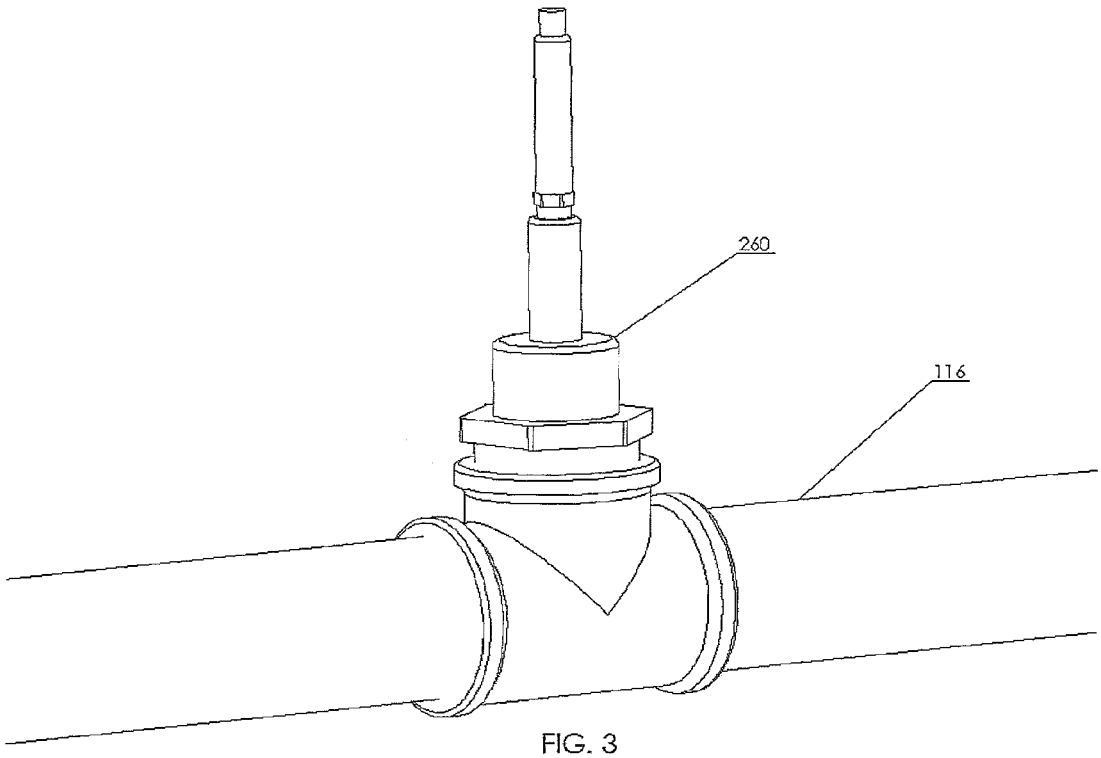
FIG. 3 illustrates a pressure sensor disposed in a paint supply line.

In this embodiment, a pressure sensor 260 is disposed in-line in the paint supply line 116. See FIG. 3. This pressure sensor is preferably operative over a sufficient temperature range to allow its use with thermoplastic melts. One such sensor is part number is: PT300PSIG-13-LI3-H1131/S1805 manufactured by Turck Inc., 3000 Campus Drive, Minneapolis, Minn. 55441. However, it will be appreciated that in other sensors may be utilized. Further, the sensor need not be disposed in the supply line as illustrated in FIG. 3. For instance, the pressure sensor may be incorporated into a manifold 118 as illustrated in FIG. 4. Stated otherwise, the pressure sensor may be mounted anywhere between a pump 132 and the paint gun 124. However, it may be desirable to position the pressure sensor proximate to the paint gun and after any filters within the system.

An embodiment of an apparatus of the invention is shown schematically in FIG. 4. The system includes a series of paint tanks 112, as well as one bead tank 114. The bead tank is weighed by one or more weigh bars 130 as discussed above. Paint flows out from the paint tanks 112, where a pump 132 pressurizes flow and supplies the paint to a supply line 116 and into a collection manifold 118. The paint then flows through second supply line 122 to the paint gun 124, where the paint is applied to the road surface. Beads flow out of the bead tank 114 through lines 126 to a series of bead guns 128, where the beads are applied to the road surface. In an alternate embodiment (not shown), the paint moves from the supply tank through the supply line 116 under the force of gravity. That is, in an alternate embodiment the system does not utilize a pump to move the material but rather relies on head pressure. The monitoring system disclosed herein is functional with both pump operated and gravity fed systems.

One or more pressure sensors 260 are used to monitor the pressure of the paint lines as paint is applied. In various embodiments, the temperature of the material is also monitored by one or more temperature probes 270. However, it will be appreciated in some embodiments, calibration information may include a known relationship between pressure and temperature and use of a temperature sensor may not be necessary. Likewise, one or more optional pump sensors 290 monitor the rpm of the pumps 132. The signals from these sensors are then transmitted back to a data box 280 where flow calculations are preformed. Alternately, such signals may be provided directly to the processor 210.

A timer box 250 opens and closes paint and bead guns. Likewise signals identifying the opening and closing of the guns are transmitted to the data box 280. The data box can consist of a PLC or microprocessor and typically incorporates computer readable storage media (not shown). The data box 280 transmits its signal back to the data processor 210. The processor 210 may be programmed with instructions to cause it to display data on a peripheral device such as a monitor 220 in the truck of the cab, or the screen of a laptop computer 230. The laptop computer 230 can then print data to a printer 240 to generate a written report that contains the data.

The correlation of the signals from any or all of the temperature sensors 270, the pressure sensors 260, and pump sensors 290, and the skip line timing box 250 and/or vehicle speed from a vehicle speed sensor 292 may be input to the data processor 210. That is, pressures taken by various sensors though out the paint line(s) are input to the data box 280 and or processor 210 which may either comprise a Programmable Logic Controller (PLC) or programmable circuit board. In its simplest form, the PLC utilizes the pressure of the supply line along with vehicle distance traveled information (e.g., vehicle speed) to determine how much material (volume and/or weight) is coming out of each paint apparatus. That is, when the volume of paint and line width is known the thickness of the line on the spray surface can then be calculated. As will be appreciated line width is typically a constant, which is based on gun type and height of the gun above a surface. The rate of a pump used to move the material and/or the temperature of the material may also be input into the PLC.

The PLC is programmed to take the input information and formulate data to be displayed to the operator. The data includes but is not limited to current material flow rate, accumulated gallons or pounds used, material line pressure, and material temperature. The information is displayed on a device such as a laptop via graphical user interface (GUI). The GUI allows the user to interact with the PLC to track the various outputs. The data is stored electronically for future reference or to be printed out in a report by a printer.

In one embodiment, the information from the processor may be displayed on the a display device (e.g., monitor 220 or laptop 230) disposed in the cab of the paint truck proximate to the operator. This allows the operator to continuously monitor paint and/or bead usage and provide a permanent record of the activities for a particular vehicle over a specified time period. In one embodiment, the system is operative to identify a change in the line pressure of 0.1 pound per square inch (PSI) and monitors the line pressure at least one per second and more typically four times per second. This continuous monitoring allows a user to adjust of the pump speed to maintain a desired line thickness. For example, if a truck is spraying a 4 inch line at 15 mph, and the line pressure is currently reading 200 psi. The system will inform the operator they are putting down a line that is 50 mils thick. If the pressure increases to 210 psi, while the pump rpms stay constant, the system recalculates the line thickness and generates and output informing the operator that the line being put down is 55 mils, which is 5 mils thicker than desired. The operator can then adjust the pump speed, accordingly to get back to 200 psi and 50 mils. In an alternate embodiment, the processor 210 may supply an output (e.g., related to line thickness) to a controller (not shown), which may automatically adjust the speed of the pump(s) 132 in order to maintain the line thickness within a desired thickness range.

In order to calculate the volume of fluid flow through the paint gun 124 for a particular product, the processor must have access to various data. Specifically, the size of the supply lines and/or the orifice size of the paint gun are necessary to effectively calculate flow volume through the system. In one arrangement, the processor utilizes predetermined calibration information in conjunction with the various sensor inputs. For example, the flow rates of the material may be determined at different temperatures for constant pressures and/or at different pressures for constant temperatures. In this regard, the relationships between temperature and pressure may be established such that the system need not necessarily measure temperature. Alternatively and/or additionally, for pump operated systems a pump may be operated a various different speeds for predetermined periods. For each different speed setting, system pressure may be recorded. Likewise the volume output of the paint gun may be recorded. This process may likewise be repeated at different material temperatures. As will be appreciated the flow volumes are dependent at least upon the size of the orifice in the paint gun and/or type of paint gun and different calibration values may be indexed against different gun sizes and/or types. Irrespective, the data is utilized to generate look-up tables or calibration curves/equations that allow for determining flow volume that is based on any or all of the variables of pressure, temperature and pump speed. Such information may be stored to computer readable storage media.

The storage of different calibration information allows user to input necessary information prior to beginning application. Such information may include, without limitation gun type, gun size, material type and/or temperature. Further, a user may operate the system for a predetermined time period in order to measure a volume of material output by one or more paint guns. This volume may be input to further refine the calibration of the system.

The foregoing description of the presented inventions has been presented for purposes of illustration and description. Furthermore, the description is not intended to limit the inventions to the forms disclosed herein. Consequently, variations and modifications commensurate with the above teachings, and skill and knowledge of the relevant art, are within the scope of the presented inventions. The embodiments described hereinabove are further intended to explain best modes known of practicing the inventions and to enable others skilled in the art to utilize the inventions in such, or other embodiments and with various modifications required by the particular application(s) or use(s) of the presented inventions. It is intended that the appended claims be construed to include alternative embodiments to the extent permitted by the prior art.

What is claimed:

1. A method for monitoring a paint line being applied to a surface by a paint application vehicle, comprising:

generating a first electronic signal from a line pressure sensor monitoring line pressure of pavement marking material in a supply line between a pavement marking material pump and a paint gun;

generating a second electronic signal representative of a speed of the vehicle over a surface;

receiving the first, and second electronic signals at a processor, wherein the processor is operative to:

calculate a paint thickness applied to the surface based on said first electronic signal representative of said line pressure and said second electronic signal representative of said speed of the vehicle;

automatically recalculate the paint thickness based on additional electronic signals from said line pressure sensor; and upon identifying a change in line pressure from the line pressure sensor, generate an output operative to alter a speed of said pavement marking material pump supplying said pavement marking material to said paint gun to maintain said paint thickness within a desired thickness range.

2. The method of claim 1, further comprising:

generating a third electronic signal representative of the temperature of the pavement marking material, wherein the third electronic signal is transmitted to the processor and utilized to calculate said flow volume.

3. The method of claim 1, further comprising generating a fourth electronic signal indicative of a speed of said pavement marking material pump used to move the pavement marking material through the supply line to the paint gun, wherein the forth electronic signal is transmitted to the processor and utilized to calculate said flow volume.

4. The method of claim 1, wherein said signal generating steps are performed at least once per second.

5. The method of claim 1, wherein calculating said flow volume further comprises:

accessing calibration data from a computer readable storage medium, wherein said calibration data includes data based at least in part on orifice sizes of said paint gun and type of said paint gun.

6. The method of claim 5, wherein said calibration data comprises a look-up table or curve generated using empirical data, wherein said look-up table or said curve is dependent on values associated with at least one of said first and second electronic signals.

7. The method of claim 6, wherein aid look-up table or said curve is further dependent on temperature of said pavement marking material.

8. The method of claim 1, further comprising:

displaying the output at a location accessible by an operator of a paint line application vehicle.

9. A device for applying a pavement marking material to a road surface, comprising:

a first tank for holding a supply of pavement marking material;

a paint gun for applying said pavement marking material to a roadway;

a paint supply line extending between said first tank and said paint gun;

a first pressure measurement device operative to generate a pressure signal representative of pavement marking material pressure within the paint supply line;

speed sensor operative to generate a vehicle speed signal associated with a speed of a vehicle supporting said paint gun; and a processor programmed to receive the pressure signal and said vehicle speed signal and to calculate a line thickness of a paint line applied by said paint gun to a road surface, wherein said processor is further programmed to automatically recalculate line thickness of the paint line after receiving an additional pressure signal and generate an output operative to alter a speed of a pump supplying the pavement marking material to the paint gun upon identifying a change in said pressure signal to maintain said paint line thickness within a desired thickness range.

10. The device of claim 9, further comprising:

a temperature sensor operative to generate a temperature signal representative of pavement marking material temperature within the paint supply line, wherein said processor receives and utilizes said temperature signal to calculate said line thickness.

11. The device of claim 9, further comprising:

a pump for moving said pavement marking material through said supply line;

a pump speed sensor operative to generate a pump speed signal, wherein said processor receives and utilizes said pump speed signal to calculate said line thickness.

12. The device of claim 10, further comprising:

a controller operatively interconnected to said processor and said pump, wherein said controller alters the speed of said pump to maintain said line thickness within a predetermined thickness range.

13. The device of claim 9, further comprising:

a display device for displaying said line thickness to an operator of said vehicle.

14. The device of claim 9, further comprising:

a computer readable storage medium, wherein said computer readable storage medium comprises calibration data associated with at least one type of said paint gun and an orifice size of said paint gun.

15. The device of claim 13, wherein said calibration data comprises at least one of a look-up table and a calibration curve, wherein said calibration data is dependent upon at least one of:

pavement marking material pressure;

pavement marking material temperature; and a pump operating parameter.

* * * * *